US011281117B2

(12) United States Patent
Watanabe

(10) Patent No.: US 11,281,117 B2
(45) Date of Patent: Mar. 22, 2022

(54) TONER FOR ELECTROSTATIC-IMAGE DEVELOPMENT AND METHOD FOR MANUFACTURING SAME

(71) Applicant: ZEON CORPORATION, Tokyo (JP)

(72) Inventor: Masashi Watanabe, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/957,596

(22) PCT Filed: Dec. 27, 2018

(86) PCT No.: PCT/JP2018/048136
§ 371 (c)(1),
(2) Date: Jun. 24, 2020

(87) PCT Pub. No.: WO2019/131877
PCT Pub. Date: Jul. 4, 2019

(65) Prior Publication Data

US 2020/0348609 A1 Nov. 5, 2020

(30) Foreign Application Priority Data

Dec. 28, 2017 (JP) ..... JP2017-253857
Mar. 30, 2018 (JP) ..... JP2018-068762
Mar. 30, 2018 (JP) ..... JP2018-068773

(51) Int. Cl.
*G03G 9/097* (2006.01)
*G03G 9/087* (2006.01)
*G03G 9/09* (2006.01)
*G03G 9/113* (2006.01)

(52) U.S. Cl.
CPC ..... *G03G 9/08711* (2013.01); *G03G 9/08759* (2013.01); *G03G 9/08764* (2013.01); *G03G 9/08793* (2013.01); *G03G 9/09* (2013.01); *G03G 9/09783* (2013.01); *G03G 9/1137* (2013.01)

(58) Field of Classification Search
None
See application file for complete search history.

(56) References Cited

U.S. PATENT DOCUMENTS

2013/0157193 A1 6/2013 Moritani et al.
2014/0301757 A1* 10/2014 Sakashita ..... G03G 9/08764 399/252

FOREIGN PATENT DOCUMENTS

JP 3-274577 A 12/1991
JP 4-361272 A 12/1992
JP 2009-168915 A 7/2009
JP 2010096928 A * 4/2010
JP 2013-145369 A 7/2013
JP 2014048576 A * 3/2014

OTHER PUBLICATIONS

English language machine translation of JP 2010-096928 (Year: 2010).*
English language machine translation of JP 2014-048576 (Year: 2014).*
International Preliminary Report on Patentability (Form PCT/IB/373) issued in counterpart International Application No. PCT/JP2018/048136 dated Jun. 30, 2020, with Form PCT/ISA/237. (11 pages).
International Search Report dated Mar. 26, 2019, issued in counterpart International Application No. PCT/JP2018/048136 (3 pages).

* cited by examiner

*Primary Examiner* — Peter L Vajda
(74) *Attorney, Agent, or Firm* — Westerman, Hattori, Daniels & Adrian, LLP

(57) ABSTRACT

The present invention provides a toner for electrostatic-image development comprising color resin particle containing a binder resin, a colorant, a charge control agent, and a thickener, wherein the binder resin is a copolymer including styrene-monomer unit and (meth)acrylate monomer unit, the thickener is a resin containing a nitrogen atom, and the content of nitrogen atom is 150 to 1500 mass ppm in the toner for electrostatic-image development.

11 Claims, No Drawings

TONER FOR ELECTROSTATIC-IMAGE DEVELOPMENT AND METHOD FOR MANUFACTURING SAME

TECHNICAL FIELD

The present invention relates to a toner for electrostatic-image development used in development in image forming apparatuses using electrophotography, such as copiers, fax machines, and printers, and a method for manufacturing the toner.

BACKGROUND ART

A method of forming an electrostatic latent image on a photosensitive member and developing the electrostatic latent image with a toner for electrostatic-image development into a desired image has been widely used in image forming apparatuses such as electrophotographic apparatuses, electrostatic recording apparatuses, and electrostatic printing apparatuses, and such apparatuses are applied to copiers, printers, fax machines, multifunction machines thereof, and the like.

For example, in an electrophotographic apparatus using electrophotography, usually, the surface of a photosensitive member composed of a photoconductive substance is uniformly charged with a variety of means, and an electrostatic latent image is formed on the photosensitive member. The electrostatic latent image is then developed with (a) toner(s) (developing step), and the resulting toner image is transferred onto a recording material such as paper as needed (transferring step). The toner(s) is/are fixed onto the recording material by heating or the like (fixing step) to obtain a printed material.

Among these steps for image formation, the fixing step usually requires heating of a fixing roll to 150° C. or more during fixing, leading to a large amount, of consumption of electricity as an energy source. To this, recent demands for energy saving and higher speed printing of the image forming apparatus have been increasing, and accompanied by this, there has been a demand for design of a toner which can maintain a high fixing rate even if the fixing temperature is reduced (toner having excellent low-temperature fixing properties).

As such a toner having excellent low-temperature fixing properties and stable fixing properties in a high temperature range, for example, Patent Document 1 discloses a technique of using a combination of binder resins in a toner comprising at least a colorant, a release agent, and a binder resin, the binder resins being a crystalline polyester resin, an amorphous polyester resin having a glass transition temperature of −60° C. or more and less than 10° C. and having urethane and/or urea bonds, and an amorphous polyester resin having a glass transition temperature of 30° C. or more and less than 70° C. and having urethane and/or urea bonds.

On the other hand, in recent years applications of images obtained by electrophotographic copiers and printers to the professional field have been actively attempted, leading to needs shifted from traditional applications of printing characters to more beautiful output of images such as photographs and graphics. For this reason, output images having higher glossiness (higher gloss properties) than ever are strongly desired.

The toner according to Patent Document 1 has stable fixing properties in a high temperature range even if the fixing temperature is reduced. However, output images obtained using the toner according to Patent Document 1 have low gloss and poor glossiness. For this reason, an improvement to provide high gloss properties has been desired.

PATENT DOCUMENTS

Patent Document 1: Japanese Patent Laid-Open No. 2013-145369

SUMMARY OF THE INVENTION

Problem to be Solved by the Invention

The present invention has been made in consideration of such circumstances. An object of the present invention is to provide a toner for electrostatic-Lavage development which provides high gloss and has stable fixing properties in a high temperature range.

Means for Solving Problems

The present inventor, who has conducted extensive research to solve the problems above, has found that a toner for electrostatic-image development which provides high gloss properties and has stable fixing properties in a high temperature range can be obtained if in a toner for electrostatic-image development comprising color resin particle containing a binder resin, a colorant, and a charge control agent, a copolymer including styrene monomer unit and (meth)acrylate monomer unit is used as the binder resin, and a specific resin having a nitrogen atom is contained in the color resin particle in an amount of nitrogen atom of 150 to 1500 mass pen in the toner for electrostatic-image development, and thus has completed the present invention.

In other words, a first aspect of the present invention provides a toner for electrostatic-image development comprising color resin particle containing a binder resin, a colorant, a charge control agent, and a thickener, wherein the binder resin is a copolymer including styrene monomer unit and (meth)acrylate monomer unit, the thickener is a resin containing a nitrogen atom, and the content of nitrogen atom is 150 to 1500 mass ppm in the toner for electrostatic-image development.

In the toner for electrostatic-image development according to the first aspect of the present invention, the thickener is preferably a resin having a urethane bond and/or a urea bond.

In the toner for electrostatic-image development according to the first aspect of the present invention, the thickener is preferably a polyether resin having a urethane bond and/or a urea bend.

In the toner for electrostatic-image development according to the first aspect of the present invention, the content of the thickener is preferably 0.2 to 5.0 parts by mass relative to 100 parts by ness of the binder resin.

A second aspect of the present invention provides a toner for electrostatic-image development, apprising color resin particle containing a binder resin, a colorant, and a charge control agent, wherein the binder resin is a copolymer including styrene monomer unit and (meth)acrylate monomer unit, the copolymer is cross-linked with a cross-linking agent, the cress-linking agent contains a cress-linkable resin, the cross-linkable resin is a resin containing a nitrogen atom, and the content of nitrogen atom is 150 to 1500 mass ppm in the toner for electrostatic-image development.

In the toner for electrostatic-image development according to the second aspect of the present invention, the cross-linkable resin is preferably a resin having a urethane bond and/or a urea bond.

In the toner for electrostatic-image development according to the second aspect of the present invention, the cross-linkable resin is preferably a polyether resin having a urethane bond and/or a urea bond. In the toner for electrostatic-image development according to the second aspect of the present invention, the cross-linkable resin is preferably a resin having a urethane bond and an (meth)acryloyl group. In the toner for electrostatic-image development according to the second aspect of the present invention, the content of the cross-linking agent is preferably 0.3 to 5.0 parts by mass relative to 100 parts by mass of the binder resin.

In the toners for electrostatic-image development according to the first and second aspects of the present invention, the binder resin preferably includes 60 to 90% by mass of the styrene monomer unit and 10 to 40% by mass of the (meth)acrylate monomer unit.

Furthermore, the present invention provides a method for manufacturing the toner for electrostatic-image development, according to the first aspect of the present invention, the method comprising a step of preparing color resin particle by dispersing a polymerizable monomer composition comprising polymerizable monomer, the colorant, the charge control agent, and the thickener and having a viscosity at 25° C. of 100 to 1000 mPa·s in an aqueous dispersive medium to form a droplet, and polymerizing the droplet, wherein the polymerizable monomer includes at least a styrene monomer and an (meth)acrylate monomer, the thickener is a resin containing a nitrogen atom, and the content of nitrogen atom is 150 to 1500 mass ppm in the toner for electrostatic-image development.

In the method for manufacturing the toner for electrostatic-image development according to the first aspect of the present invention, the polymerizable monomer further includes a polymerizable monomer which is cross-linkable, and the amount of the polymerizable monomer which is cross-linkable to be used is preferably 2.0 parts by mass or less in 100 parts by mass of the total amount of the polymerizable monomer.

Moreover, the present invention provides a method for manufacturing the toner for electrostatic-image development according to the second aspect of the present invention, the method comprising a step of preparing color resin particle by dispersing a polymerizable monomer composition comprising polymerizable monomer, the colorant, the charge control agent, and the cross-linking agent in an aqueous dispersive medium to form a droplet, and polymerizing the droplet, wherein the polymerizable monomer includes at least a styrene monomer and an (meth)acrylate monomer, the cross-linking agent contains a cross-linkable resin, the cross-linkable resin is a resin containing a nitrogen atom, and the content of nitrogen atom is 150 to 1500 mass ppm in the toner for electrostatic-image development.

Furthermore, still another aspect according to the present invention can provide a toner for electrostatic-image development comprising color resin particle containing a binder resin, a colorant, a charge control agent, and a thickener, wherein the binder resin is a copolymer including styrene monomer unit and (meth)acrylate monomer unit, and the thickener has a urethane bond and/or a urea bend.

Moreover, still another aspect according to the present invention can provide a toner for electrostatic-image development comprising color resin particle containing a binder resin, a colorant, and a charge control agent, wherein the binder resin is a copolymer including styrene monomer unit and (meth)acrylate monomer unit, the copolymer is cross-linked with a cross-linking agent, the cross-linking agent contains a cross-linkable resin, and the cross-linkable resin is a polyether resin having a urethane bond and/or a urea bond.

Effects Of Invention

The present invention can provide a toner for electrostatic-image development which can provide high gloss and has stable fixing properties in a high temperature range, and a method for manufacturing the toner.

DESCRIPTION OF EMBODIMENTS

<First Embodiment>

First, the toner for electrostatic-image development according to the first embodiment of the present invention (hereinafter, simply referred to as "toner" in some cases) is a toner for electrostatic-image development comprising color resin particle containing a binder resin, a colorant, a charge control agent, and a thickener, wherein the binder resin is a copolymer including styrene monomer unit and (meth)acrylate monomer unit (which means acrylate monomer unit and/or methacrylate monomer unit. The same applies to the following description), the thickener is a resin containing a nitrogen atom, and such a resin having a nitrogen atom is contained such that the content of nitrogen atom is 150 to 1500 mass ppm in the toner for electrostatic-image development.

First, the process of producing color resin particles forming the toner according to the first, embodiment will be described.

The process of producing color resin particles forming the toner according to the first embodiment is mainly classified into dry processes such as a pulverization process and wet processes such as emulsion polymerization aggregation, dispersion polymerization, suspension polymerization, and dissolution suspension processes. Preferred are wet processes, which facilitate preparation of toners having high printing properties such as image reproductivity. Among these wet processes, more preferred are polymerization processes such as emulsion polymerization aggregation, dispersion polymerization, and suspension polymerization processes because these facilitate preparation of toners having a particle size in micrometers and a relatively snail particle size distribution. Among these, a suspension polymerization process is still more preferred.

The emulsion polymerization aggregation process is a process of producing color resin particles by polymerizing a polymerizable monomer in an emulsion to prepare resin fine particles, and aggregating the resin fine particles with a colorant and the like. The dissolution suspension process is a process of producing color resin particles by dissolving or dispersing toner components such as a binder resin and a colorant in an organic solvent to prepare a solution, dispersing the solution in an aqueous medium to form a droplet, and then removing the organic solvent. In these processes, known techniques can be used.

The color resin particles forming the toner according to the first embodiment can be produced by any of the wet processes and the dry processes. If (A) a suspension polymerization process as a preferred wet process or (B) a pulverization process as a representative dry process is used to produce the color resin particles, the production is performed by the following process. First, (A) the suspension polarization process will be described.

(A) Suspension Polymerization Process (1) Step of Preparing Polymerizable Monomer Composition (A) In the suspension polymerization process, first, polymerizable monomer, the colorant, the charge control agent, the thickener, and other additives optionally used, such as a release agent and a molecular weight adjuster, are mixed and dissolved to prepare a polymerizable monomer composition. During the preparation of the polymerizable monomer composition, these materials are mixed using a media-type dispersing machine, for example.

In the first embodiment, the polymerizable monomer indicates a polymerizable compound. The polymerizable monomer is converted into a binder resin as a result of polymerization. To prepare the resulting binder resin as a copolymer including styrene monomer unit and (meth) acrylate monomer unit, mainly a styrene monomer and an (meth)acrylate monomer are used as the polymerizable monomer.

Examples of the styrene monomer include styrene, vinyltoluene, methylstyrene, ethylstyrene, and the like. These styrene monomers may be used alone or in combination. Among these, preferred are styrene, vinyltoluene, and methylstyrene, and more preferred is styrene.

Examples of the (meth)acrylate monomer include methyl acrylate. ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, and the like. These (meth)acrylate monomers may be used alone or in combination. Among these, preferred are ethyl acrylate, propyl acrylate, and butyl acrylate, and more preferred is n-butyl acrylate.

The proportion of the styrene monomer unit contained in the binder resin used in the first embodiment is preferably 60 to 90% by mass, mere preferably 65 to 85% by mass, still more preferably 70 to 80% by mass. The proportion of the (meth)acrylate monomer unit is preferably 10 to 40% by mass, more preferably 15 to 35% by mass, still more preferably 20 to 30% by mass, control of the proportions of the styrene monomer unit and the (meth)acrylate monomer unit within these ranges results in a toner having high heat-resistant storage properties and excellent low-temperature fixing properties in a good balance.

A different polymerizable monomer other than the styrene monomer and the (meth)acrylate monomer may also be used as the polymerizable monomer to prepare the binder resin used in the first embodiment. As such a different polymerizable monomer, a polymerizable monomer which is cross-linkable is preferably used. It is sufficient that the polymerizable monomer which is cross-linkable is a monomer having two or more polymerizable functional groups and/or a monomer having a polymerizable functional group and a cross-linkable functional group. Examples thereof include aromatic divinyl compounds such as divinylbenzene, divinyl naphthalene, and derivatives thereof; ester compounds of two or more carboxylic acids having a carbon-carbon double bond bonded to an alcohol having two or more hydroxyl groups via ester bonds, such as ethylene glycol dimethacrylate and diethylene glycol dimethacrylate; other divinyl compounds such as N,N-divinylaniline and divinyl ether; compounds having three or more vinyl groups; and the like. Among these, divinylbenzene is preferred from the viewpoint of cross-linkability. These polymerizable monomers which are cross-linkable may be used alone or in combination.

In the first embodiment, the amount of the polymerizable monomer which is cross-linkable to be used is preferably 2.0 parts by mass or less, more preferably 0.1 to 1.0 part by mass, still more preferably 0.2 to 0.7 parts by mass, further still more preferably 0.2 to 0.5 parts by mass in 100 parts by mass of the total amount of the polymerizable monomer used to prepare the binder resin. In other words, the proportion of the polymerizable monomer which is cross-linkable unit contained in the binder resin used in the first embodiment is preferably 2.0% by mass or less, more preferably 0.1 to 1.0% by mass, still more preferably 0.2 to 0.7% by mass, further still more preferably 0.2 to 0.5% by mass. Control of the amount and proportion of the polymerizable monomer which is cross-linkable within these ranges; can provide a binder resin having a relatively low degree of cross-linking during cross-linking. Thus, the resulting toner can have stable fixing properties in a high temperature range while providing output images having enhanced gloss properties.

Monovinyl monomers other than the styrene monomer and the (meth)acrylate monomer may also be used as the different monomer used in the first embodiment to prepare the binder resin. Examples of the monovinyl monomers include acrylic acid and methacrylic acid; nitrile compounds such as acrylonitrile and methacrylonitrile; amide compounds such as acrylamide and methacrylamide; olefins such as ethylene, propylene, and butylene; and the like. These monovinyl monomers may be used alone or in combination. The amount of the monovinyl monomer other than the styrene monomer and the (meth)acrylate monomer used in the first embodiment is preferably 3 parts by mass or less, more preferably 0.1 to 2.5 parts by mass, still more preferably 0.5 to 2.0 parts by mass in 100 parts by mass of the total amount of the polymerizable monomer used to prepare the binder resin. In other words, the proportion of unit of the monovinyl monomer other than the styrene monomer and the (meth)acrylate monomer used in the first embodiment is preferably 3% by mass or less, more preferably 0.1 to 2.5% by mass, still more preferably 0.5 to 2.0% by mass.

Any macromonomer is preferably used as part of the polymerizable monomer because use of such a macromonomer results in a good balance between the storage properties of the toner and the low-temperature fixing properties thereof. The macromonomer refers to a reactive oligomer or polymer having a terminal polymerizable carbon-carbon unsaturated bond and having a number average molecular weight (Mn) of usually 1000 to 30000. Preferred macromonomers are those which provide a polymer having a glass transition temperature (Tg) higher than that of the polymer obtained without polymerization of the macromonomer.

Colorants are used in the first embodiment. If color toners (usually, four toners of black, cyan, yellow, and magenta toners are used) are produced, a black colorant, a cyan colorant, a yellow colorant, and a magenta colorant are used for the respective color toners.

Examples of the black colorant to be used include pigments and dyes such as carbon black, titanium black, magnetic powders of zinc iron oxide and nickel iron oxide, and the like.

Examples of the cyan colorant to be used include compounds such as copper phthalocyanine pigments and derivatives thereof, and anthraquinone pigments and dyes. Specifically, examples thereof include C.I. Pigment Blues 2, 3, 6, 15, 15:1, 15:2, 15:3, 15:4, 16, 17:1, 60, and the like.

Examples of the yellow colorant to be used include compounds such as azo pigments such as monoazo pigments and disazo pigments, and fused polycyclic pigments and dyes. Specifically, examples thereof include Pigment Yellows 3, 12, 13, 14, 15, 17, 62, 65, 74, 83, 93, 97, 120, 138, 151, 155, 180, 181, 185, 186, 214, and 219; and C.I. Solvent Yellows 99, 152, and 179; and the like.

Examples of the magenta colorant to be used include compounds such as azo pigments such as monoazo pigments and disazo pigments; fused polycyclic pigments and dyes; and the like. Specifically, examples thereof include C.I. Pigment Reds 31, 48, 57:1, 58, 60, 63, 64, 68, 81, 83, 87, 68, 89, 90, 112, 114, 122, 123, 144, 146, 149, 150, 163, 170, 134, 135, 187, 202, 206, 207, 209, and 251; C.I. Solvent Violets 31, 47, and 59; C.I. Pigment Violet 19; and the like.

In the first embodiment, these colorants of the respective colors may be used alone or in combination, and the amount of the colorant of each color to be used is preferably 1 to 10 parts by mass relative to 100 parts by mass of the polymerizable monomer used to prepare the binder resin.

The charge control agent to be used can be a variety of charge control agents having positive or negative charging properties. Examples thereof include non-resin charge control agents such as metal complexes of organic compounds having a carboxyl or nitrogen group, metal-containing dyes, and nigrosine; charge control resins such as quaternary ammonium salt structure-containing copolymers, sulfonic acid group or sulfonate structure-containing copolymers, and carboxyl croup or carboxylate structure-containing copolymers; and the like. Among these, preferred charge control agents to be used are those containing charge control resins, which provide favorable print durability to the toner. In the first embodiment, as the charge control agent, a non-resin charge control agent may be used in combination with a charge control resin, or a charge control resin may be used alone. From the viewpoint of the print durability of the toner, it is more preferred that a charge control resin be used alone. The amount of the charge control agent to be used is preferably 0.01 to 10 parts by mass, more preferably 0.03 to 8 parts by mass relative to 100 parts by mass of the polymerizable monomer used to prepare the binder resin.

In the first embodiment, a resin containing a nitrogen a tan is used as the thickener. As such a resin, a resin having a urethane bond and/or a urea bend is preferably used, and a polyether resin having a urethane bond and/or a urea bond is more preferably used. In the first embodiment, the resulting toner can have stable fixing properties in a high temperature range and provide highly glossy output images by compounding a resin containing a nitrogen atom as the thickener, in addition to the binder resin comprising a copolymer including styrene monomer unit and (meth) acrylate monomer ion it, the colorant, and the charge control agent, such that 150 to 1500 mass ppm of nitrogen atom is contained in the toner for electrostatic-image development. In particular, it is inferred that pseudo cross-linking points (flexible cross-linking points) can be formed between the resin containing a nitrogen atom (thickener) and the binder resin through hydrogen bonds by using such a resin having a nitrogen atom as the thickener and compounding the resin having a nitrogen atom such that the amount of nitrogen atom is 150 to 1500 mass ppm in the toner. Thus, in the first embodiment, heat resistance can be enhanced by the pseudo cross-linking points while the elasticity of the cress-linkable resin is maintained. This results in stable fixing properties in a high temperature range and highly glossy output images.

In particular, if the black colorant is used as the colorant, the fixing properties in a high temperature range are likely to be reduced compared to the cases where other colorants are used. In the first embodiment, a large effect is demonstrated by compounding the resin containing a nitrogen atom, which results in a preferred toner.

The resin containing a nitrogen atom is preferably a resin having a urethane bond and/or a urea bend in the molecular structure, more preferably a polyether resin having a urethane bond and/or a urea bond, still more preferably a polyether resin having a urea bond. Examples of the polyether resin having a urethane bond and/or a urea bond include polymers or copolymers having an ether bond. Examples thereof include urethane bond and/or urea bond-containing polyoxyethylene-based polyethers, polyoxypropylene-based polyethers, polyoxybutylene-based polyethers, polyethers derived from aromatic polyhydroxy compounds such as bisphenol A and bisphenol F, and the like.

The urethane bond (—NHCOO— bond) is usually a bond formed through the reaction of an is compound (R—NCO) with a hydroxy compound. The urea bond (—NHCONH— bond) is usually a bend formed through the reaction of an isocyanate compound (R—NCO) with an amino compound. In the case where the polyether resin having a urethane bond and/or a urea bond is used, the proportion of monomer unit derived from such an isocyanate compound (namely, the proportion of the urethane bond and the urea bond) in the polyether resin having a urethane bond and/or a urea bond is preferably 0.15% by mass or more, more preferably 0.25 to 2.5% by mass, still more preferably 0.50 to 2.0% by mass to more appropriately enhance the gloss properties and the fixing properties in a high temperature range. The proportion of the monomer unit derived from such an isocyanate compound in the polyether resin having a urethane bond and/or a urea bond can be determined by a known standard analysis method which can quantify the nitrogen element.

The polyether resin having a urethane bond and/or a urea bond is synthesized using a polyisocyanate, a polyether polyol, or a polyamine.

Examples of the polyisocyanate include aliphatic polyisocyanates, aromatic polyisocyanate, and the like.

Examples of the aliphatic polyisocyanates include polyisocyanates having a linear structure such as tetramethylene diisocyanate, hexamethylene diisocyanate, dodecamethylene diisocyanate, 2,2,4-trimethylhexamethylene diisocyanate, 2,4,4-trimethylhexamethlylene diisocyanate, lysine diisocyanate, 2-methylpentane-1,5-diisocyanate, and 3-methylpentane-1,5-diisocyanate; polyisocyanates having a cyclic structure such as isophorone diisocyanate, hydrogenated xylylene diisocyanate, 4,4'-dicyclohexylmethane diisocyanate, 1,4-cyclohexane diisocyanate, methylcyclohexylene diisocyanate, and 1,3-bis(isocyanate methyl)cyclohexane; and the like.

Examples of the aromatic polyisocyanates include tolylene diisocyanate, 2,2'-diphenylmethane diisocyanate, 2,4'-diphenylmethane diisocyanate, 4,4'-diphenylmethane diisocyanate, 4,4'-dibenzyl diisocyanate, 1,5-naphthylene diisocyanate, xylylene diisocyanate, 1,3-phenylene diisocyanate, 1,4-phenylene diisocyanate, dialkyldiphenylmethane diisocyanates, tetraalkyldiphenylmethane diisocyanates, α,α,α,α-tetramethylxylylene diisocyanate, and the like.

These may be used alone or in combination.

Examples of the polyether polyol include addition polymerized products of alkylene oxides and polyols; glycols such as (poly)alkylene glycols; and the like.

Examples of the alkylene oxides include ethylene oxide, propylene oxide, butylene oxide, α-olefin oxide, and the like.

Examples of the polyols subjected to addition polymerization with alkylene oxides include diols such 1,3-propanediol, 1,3-butanediol, 1,4-butanediol, 1,5-pentanediol, 1,6-hexanediol, 3-methyl-1,5-pentanediol, 2-butyl-2-ethyl-1,3-propanediol, 1,4-cyclohexane diol, 1,4-cyclohexanedimethanol, 4,4-dihydroxyphenylpropane, 4,4-dihydroxyphenylmethane, hydrogenated bisphenol A, bisphenol A, bisphenol F, bisphenol S, and dimethylol urea and derivatives thereof; triols such as glycerol, trimethylopropane, 1,2,5-hexanetriol, 1,2,6-hexanetriol, pentaerythritol, trimethylolmelamine and derivatives thereof, and polyoxypropylenetriol; and the like.

Examples of the glycols include (poly)alkylene glycols such as hexamethylene glycol, tetramethylene glycol, ethylene glycol, diethylene glycol, triethylene glycol, tetraethylene glycol, polyethylene glycol, propylene glycol, dipropylene glycol, tripropylene glycol, polypropylene glycol, (poly) tetramethylene glycol, and neopentyl glycol; ethylene glycol-propylene glycol copolymers; and the like.

These may be used alone or in combination.

Examples of the polyamine include aliphatic polyamines, aromatic polyamines, and the like.

Examples of the aliphatic polyamines include ethylenediamine, propylenediamine, hexamethylenediamine, diethylenetriamine, triethylene tetramine, 1,2-cyclohexanediamine, 1-amino-3-aminomethyl-3,5,5-trimethylcyclohexane, dicyclohexylmethane-4,4'-diamine, 2-hydroxyethylethylenediamine, 2-hydroxyethylpropyldiamine, 2-hydroxyethylpropylenediamine, di-2-hydroxyethylethylenediamine, di-2-hydroxyethylenediamine, di-2-hydroxyethylpropylenediamine, (N-aminoethyl)-2-ethanolamine, 2-hydroxypropylethylenediamine, di-2-hydroxypropylethylenediamine, di-2-hydroxypropylethylenediamine, and the like.

Examples of the aromatic polyamines include 1,2-, 1,3-, and 1,4-phenylenediamines, 2,4'- and 4,4'-diphenylmethanediamines, crude diphenylmethanediamine (polyphenylpolymethylenepolyamine), diaminodiphenylsulfone, benzidine, thiodianiline, bis (3,4-diaminophenyl)sulfone, 2,6-diaminopyridine, m-aminobenzylamine, triphenylmethane-4,4',4"-triamine, naphthylenediamine, 2,4- and 2,6-tolylenediamines, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3', 5,5'-tetramethylbenzidine, 3,3',5,5'-tetramethyl-4,4'-diaminodiphenylmethane, 3,5-diethyl-3'-methyl-2', 4-diaminodiphenylmethane, 3,3'-diethyl-2,2'-diaminodiphenylmethane, 4,4'-diamino-3,3'-dimethyldiphenylmethane, 3,3', 5,5'-tetraethyl-4,4'-diaminobenzophenone, 3,3', 5,5'-tetraethyl-4,4'-diaminodiphenyl ether, 3,3',5,5'-tetraisopropyl-4,4'-diaminodiphenylsulfone, and the like.

These may be used alone or in combination.

The resin containing a nitrogen atom used in the first embodiment has a weight average molecular weight (Mw) of preferably 800 to 10000, more preferably 1000 to 5000, still more preferably 1200 to 3000 because the inventive effects of the first embodiment are readily obtained. The weight average molecular weight (Mw) can be determined by measurement by gel permeation chromatography, for example, as a value against polystyrene standards. A specific example of the measurement condition will be shown below.

0.1 g of a resin precisely weighed is placed into a 100-mL glass sample bottle, and 49.9 g of tetrahydrofuran (THF) is added. In the next step, a stirrer chip is placed thereinto, followed by stirring at room temperature for one hour using a magnetic stirrer. The resulting product is filtered through a 0.2-μm PTFE filter to prepare a THF solution of the resin. Finally, 100 μL of the THF solution is injected to a gel permeation chromatograph (GPC) to perform measurement by GPC. The weight average molecular weight (Mw) is converted from the resulting GPC elution profile using a calibration curve according to commercially available monodisperse standard polystyrenes.

(GPC Measurement Condition)

GPC: HLC-8220 (Available from Tosoh Corporation)

columns: two TSK-GEL MULTIPORE HXL-M columns connected in series (available from Tosoh Corporation)

eluent: THF flow rate: 1.0 mL/min temperature: 40° C.

From the viewpoint of low-temperature fixing properties, the resin containing a nitrogen atom used in the first embodiment has a glass transition temperature (Tg) of preferably 50 to 120° C., more preferably 60 to 110° C., still more preferably 70 to 100° C.

In the toner according to the first embodiment, the content of nitrogen atom derived from the thickener is 150 to 1500 mass ppm in the toner. Thereby, the resulting toner can provide high gloss and have stable fixing properties in a high temperature range. The content of nitrogen atom derived from the thickener is preferably 200 to 1300 mass ppm, more preferably 250 to 1200 mass ppm, still more preferably 400 to 1000 mass ppm. The content of nitrogen atom derived from the thickener can be adjusted by controlling the content of nitrogen atom contained in the resin as the thickener and the amount of the thickener to be used.

The content of nitrogen atom can be measured by a chemiluminescence method using a nitrogen analyzer. While the toner may contain nitrogen atom derived from the components other than the thickener, the content of nitrogen atom described above indicates the content of only nitrogen atom derived from the thickener. Accordingly, the content of nitrogen atom derived from the components other than the thickener should be subtracted from the content of nitrogen atom measured by the chemiluminescence method.

The content of the resin containing a nitrogen atom as the thickener is preferably 0.2 parts by mass or more, more preferably 0.3 parts by mass or more, still more preferably 0.5 parts by mass or more, and preferably 5.0 parts by mass or less, more preferably 4.0 parts by mass or less, still more preferably 2.2 parts by mass or less, particularly preferably 2.0 parts by mass or less relative to 100 parts by mass of the binder resin. Control of the content of the resin containing a nitrogen atom within this range results in a toner having enhanced gloss properties and having enhanced fixing properties in a high temperature range.

In the first embodiment, preferably, the resin containing a nitrogen atom as the thickener is added in the form of a solution prepared by dissolving the resin containing a nitrogen atom in a solvent. Thereby, the effects of adding the resin containing a nitrogen atom can be more appropriately demonstrated. The solvent may be any solvent which can dissolve the resin containing a nitrogen atom. Examples thereof include dimethyl sulfoxide, N-methyl-2-pyrrolidone, N-formylmorpholine, and the like. If the resin containing a nitrogen atom is added in the form of a solution of the resin dissolved in a solvent, the proportion of the resin containing a nitrogen atom in the solution is not particularly limited. The proportion is preferably 10 to 60% by mass, more preferably 30 to 55% by mass.

A commercially available product may be used as the resin containing a nitrogen atom. Examples of commercially available products of the polyether resin having a urea bond include trade names BYK-D410, BYK-410, and BYK-D411 (all available from BYK Japan K.K.), and the like. These are polyether resins having a urea bond dissolved in a solvent and can be used as they are or can be used after diluted.

As another additive, it is preferred that a release agent be further added. Addition of release agent can improve the releasing properties of the toner from the fixing roll during fixing. The release agent can be any release agent usually used for toners.

Examples of the release agent include low molecular weight polyolefin waxes such as low molecular weight polyethylene, low molecular weight polypropylene, and low molecular weight polybutylene, terminal-modified polyolefin waxes such as molecular terminal-oxidized low molecular weight polypropylenes, terminal-modified low molecular weight polypropylenes having a molecular terminal substituted by an epoxy group, block polymers of these and low molecular weight polyethylenes, molecular terminal-oxidized low molecular weight polyethylenes, low molecular weight polyethylenes having a molecular terminal substituted by an epoxy group, and block polymers of these and low molecular weight polypropylenes; plant-based natural waxes such as candelilla wax, carnauba wax, rice bran wax, Japan wax, and jojoba wax; petroleum waxes such as paraffin, microcrystalline wax, and petrolatum and modified waxes thereof; mineral waxes such as montan wax, ceresin, and ozokerite; synthetic waxes such as Fischer-Tropsch wax; fatty acid ester compounds of polyhydric alcohols; mixtures thereof; and the like.

Among these release agents, preferred are fatty acid ester compounds of polyhydric alcohols because these enhance the low-temperature fixing properties of the toner without deteriorating print durability. Examples of the fatty acid ester compounds of polyhydric alcohols include pentaerythritol esters such as pentaerythritol tetramyristate, pentaerythritol tetradipalmitate, pentaerythritol tetrastearate, and pentaerythritol tetralaurate; dipentaerythritol esters such as dipentaerythritol hexamyristate, dipentaerythritol hexadipalmitate, and dipentaerythritol hexalaurate; fatty acid ester compounds of polyglycerols; and the like. Among these, preferred are pentaerythritol esters.

The lower limit of the amount of the release agent to be used is preferably 1 part by mass or more, more preferably 3 parts by mass or more, still more preferably 5 parts by mass or more, particularly preferably 12 parts by mass or more relative to 100 parts by mass of the polymerizable monomer used to prepare the binder resin, and the upper limit is preferably 30 parts by mass or less, more preferably 25 parts by mass or less, still more preferably 20 parts by mass or less.

Furthermore, a molecular weight adjuster may be used as another additive. Examples of the molecular weight adjuster include mercaptans such as t-dodecylmercaptan, n-dodecylmercaptan, n-octylmercaptan, and 2,2,4,6,6-pentamethylheptane-4-thiol; thiuram disulfides such as tetramethylthiuram disulfide, tetraethylthiuram disulfide, tetrabutylthiuram disulfide, N,N'-dimethyl-N,N'-diphenylthiuram disulfide, and N,N'-dicotadecyl-N,N'-diisopropylthiuram disulfide; and the like. The molecular weight adjuster can be added before the start of polymerization or during polymerization. The amount of the molecular weight adjuster to be used is preferably 0.01 to 10 parts by mass, more preferably 0.1 to 5 parts by mass relative to 100 parts by ness of the polymerizable monomer used to prepare the binder resin.

In the first embodiment, the polymerizable monomer composition can be prepared by mixing the components described above with a media-type dispersing machine or the like. In the first embodiment, the viscosity at 25° C. of the polymerizable monomer composition thus prepared falls within the range of preferably 100 to 1000 mPa·s, more preferably 150 to 800 mPa·s, still more preferably 200 to 700 mPa·s. In the first embodiment, while the polymerizable monomer composition has a relatively large viscosity because of the resin containing a nitrogen atom as the thickener contained in the polymerizable monomer composition, the viscosity of the polymerizable monomer composition can be controlled by dispersing the resin containing a nitrogen atom in a solvent and adding the resin in the form of a solution and by adjusting the concentration in the solution, control of the viscosity at 25° C. of the polymerizable monomer composition within this range results in a toner having higher fixing properties in a high temperature range. The viscosity at 25° C. of the polymerizable monomer composition can be measured using a B type viscometer, for example.

(2) Suspending Step of Preparing Suspension (Droplet Formation Step)

In the next step, the polymerizable monomer composition prepared through (1) Step of preparing polymerizable monomer composition above can be dispersed and suspended in an aqueous dispersive medium to prepare a suspension (polymerizable monomer composition dispersion). Here, the term "suspension" means that droplet of a polymerizable monomer opposition are formed in an aqueous dispersive medium. A dispersion treatment for forming droplet can be performed using an apparatus enabling strong stirring, such as an in-line emulsifying/dispersing machine (available from Pacific Machinery & Engineering Co., Ltd., trade name: Milder) or a high speed emulsifying/dispersing machine (available from Tokushu Kika Kogyo Co., Ltd., trade name: T. K. homomixer MARK II).

In the first embodiment, although the aqueous dispersive medium may be water alone, water can also be used in combination with water-soluble solvents such as lower alcohols and lower ketones.

In the first embodiment, the aqueous dispersive medium preferably contains a dispersion stabilizer. Examples of the dispersion stabilizer include metal compounds such as sulfates such as barium sulfate and calcium sulfate; carbonates such as barium carbonate, calcium carbonate, and magnesium carbonate; phosphates such as calcium phosphate; metal oxides such as aluminum oxide and titanium oxide; metal hydroxides such as aluminum hydroxide, magnesium hydroxide, and ferric hydroxide; and the like; and organic compounds such as water-soluble polymers such as poly (vinyl alcohol), methyl cellulose, and gelatin; anionic surfactants; nonionic surfactants; amphoteric surfactants; and the like.

Among these dispersion stabilizers, dispersion stabilizers containing colloids of metal compounds, particularly, poorly water-soluble metal hydroxides are preferred for the following reasons: These dispersion stabilizers can provide color resin particles having a narrow particle size distribution. Moreover, the amount of residual dispersion stabilizer after washing is reduced, resulting in a toner which enables reproduction of sharp images without degrading the image quality under a high temperature and a high humidity, in particular.

These dispersion stabilizers may be used alone or in combination. The amount of the dispersion stabilizer to be added is preferably 0.1 to 20 parts by mass, more preferably 0.2 to 10 parts by mass relative to 100 parts by mass of the polymerizable monomer used to prepare the binder resin.

It is also preferred that the polymerizable monomer composition be dispersed in the aqueous dispersive medium, and then a polymerization initiator be added before formation of droplet. The polymerization initiator may be added in (1) Step of preparing polymerizable monomer composition above.

Examples of the polymerization initiator include persulfates such as potassium persulfate and ammonium persulfate; azo compounds such as 4,4'-azobis(4-cyanovaleric acid), 2,2'-azobis(2-methyl-N-(2-hydroxyethyl)propionamide, 2,2'-azobis(2-amidinopropane)dihydrochloride, 2,2'-azobis(2,4-dimethylvaleronitrile), and 2,2'-azobisisobutyronitrile; organic peroxides such as di-t-butyl peroxide, benzoyl peroxide, t-butyl peroxy-2-ethylhexanoate, t-hexyl peroxy-2-ethylhexanoate, t-butyl peroxypivalate, t-butyl peroxy-2-ethylbutanoate, diisopropyl peroxydicarbonate, di-t-butyl peroxyisophthalate, and t-butyl peroxyisobutyrate; and the like. among these, use of organic peroxides is preferred because the amount of residual polymerizable monomer can be reduced and high print durability is provided.

The amount of the polymerization initiator to be used is preferably 0.1 to 20 parts by mass, more preferably 0.3 to 15 parts by mass, still mare preferably 1.0 to 10 parts by mass relative to 100 parts by mass of the polymerizable monomer used to prepare the binder resin.

(3) Polymerization Step

The desired suspension (aqueous dispersive median containing droplet of the polymerizable monomer composition) prepared through (2) Step of preparing suspension (droplet formation step) above is heated to initiate polymerization. Thereby, an aqueous dispersion of color resin particles is prepared.

In the first embodiment, the polymerization temperature is preferably 50° C. or more, more preferably 60 to 98° C. In the first embodiment, the polymerization time is preferably 1 to 20 hours, more preferably 2 to 15 hours.

To perform polymerization in the state where the droplet of the polymerizable monomer composition are stably dispersed, in the polymerization step subsequent to (2) Step of preparing suspension (droplet formation step), the polymerization reaction may be progressed while a dispersion treatment using stirring is being performed.

In the first embodiment, an external additive may be added to the color resin particles thus prepared as they are, and the product may be used as a toner. Alternatively, so-called core-shell type (or also referred as "capsule type") color resin particles may be prepared, the color resin particles comprising a core layer of color resin particles prepared through the polymerization step and a shell layer which is different from the core layer and deposited on the outer side thereof. In the core-shell type color resin particles, a core layer made of a substance having a low softening point is coated with a substance having a softening point higher than that. Thereby, a reduction in fixing temperature of the toner can be balanced with prevention of aggregation during storage.

The core-shell type color resin particles can be produced by any known traditional method. Preferred are in situ polymerization and phase separation from the viewpoint of production efficiency.

A method of producing the core-shell type color resin particles by in situ polymerization will now be described.

In the case of in situ polymerization, a polymerizable monomer for forming a shell layer (polymerizable monomer for a shell) and a polymerization initiator for a shell are added to the aqueous dispersive medium having color resin particles dispersed therein, followed by polymerization. Thereby, the core-shell type color resin particles can be prepared.

The polymerizable monomer for a shell to be used can be the same polymerizable monomer as described above. Among these, it is preferred that monomers (such as styrene and methyl methacrylate) which can provide a polymer having a Tg more than 80° C. be used alone or in combination.

Examples of the polymerization initiator for a shell used in polymerization of the polymerizable monomer for a shell include polymerization initiators such as persulfuric acid metal salts such as potassium persulfate and ammonium persulfate; water-soluble azo compounds such as 2,2'-azobis (2-methyl-N-(2-hydroxyethyl)propionamide), and 2,2'-azobis-(2-methyl-N-(1,1-bis(hydroxymethyl)2-hydroxyethyl) propionamide); and the like. The amount of the polymerization initiator for a shell to be used is preferably 0.1 to 30 parts by mass, more preferably 1 to 20 parts by mass relative to 100 parts by mass of the polymerizable monomer for a shell.

The polymerization temperature of the shell layer is preferably 50° C. or more, more preferably 60 to 95° C. The polymerization time of the shell layer is preferably 1 to 20 hours, more preferably 2 to 15 hours.

(4) Washing, filtration, dehydration, and drying steps

After the end of polymerization, it is preferred that the aqueous dispersion of the color resin particles prepared through (3) Polymerization step above be repeatedly, as needed, subjected to a series of operations of washing, filtration, dehydration, and drying according to a normal method.

First, to remove the residual dispersion stabilizer in the aqueous dispersion of the color resin particles, it is preferred that the aqueous dispersion of the color resin particles be washed by adding an acid or an alkali. If the dispersion stabilizer used is an inorganic confound soluble to acids, washing is preferably performed by adding an acid to the aqueous dispersion of the color resin particles. If the dispersion stabilizer used is an inorganic compound soluble to alkalis, washing is preferably performed by adding an alkali to the aqueous dispersion of the color resin particles.

If an inorganic compound soluble to acids is used as the dispersion stabilizer, it is preferred that an acid be added to the aqueous dispersion of the color resin particles to adjust the pH to preferably 6.5 or less, mere preferably 6 or less. The acid to be added can be inorganic acids such as sulfuric acid, hydrochloric acid, and nitric acid, and organic acids such as formic acid and acetic acid. Particularly suitable is sulfuric acid because of its great efficiency in removing the dispersion stabilizer and a small load to production facilities.

(B) Pulverization Process

If the pulverization process is used, the color resin particles are produced by the following process.

First, the binder resin, the colorant, the charge control agent, and the resin containing a nitrogen atom as the thickener, and other additives optionally used such as a release agent and a molecular weight adjuster are mixed using a mixer, such as a ball mill, a V type mixer, an FM mixer (trade name), a high speed dissolver, an internal mixer, or a Forberg mixer. In the next step, the resulting mixture is kneaded under heating using a pressure kneader, a twin-screw extrusion kneader, a roller, or the like. The kneaded product is crushed using a mill such as a hammer mill, a cutter mill, a roller mill, or the like. Furthermore, the product is pulverized using a mill such as a jet mill, a high speed rotary mill, or the like, and is classified into a desired particle size with a classifier such as an air classifier, an air stream classifier, or the like. Thus, color resin particles can be prepared by the pulverization process.

The binder resin, the colorant, the charge control agent, and the resin containing a nitrogen atom as the thickener, and optional other additives such as a release agent and a molecular weight adjuster used in the pulverization process can be the same as those listed in (A) Suspension polymerization process above. Moreover, the color resin particles prepared by the pulverization process can be formed into the core-shell type color resin particles by a method such as in situ polymerization as in the color resin particles prepared by (A) Suspension polymerization process above.

(Color Resin Particles)

The color resin particles are prepared through (A) Suspension polymerization process or (B) Pulverization process above.

The color resin particles forming a toner will now be described. The color resin particles described below comprise both color resin particles of a core-shell type and those of a non-core-shell type.

From the viewpoint of image reproductivity, the color resin particles have a volume average particle size Dv of preferably 3 to 15 μm, more preferably 4 to 12 μm, still more preferably 4 to 9 μm, particularly preferably 5 to 8 μm. If the color resin particles have a volume average particle size Dv below this range, the resulting toner may have reduced fluidity, facilitating degradation of image quality due to fogging or the like in some cases. In contrast, if the color resin particles have a volume average particle size Dv beyond this range, the resolutions of the resulting images may be reduced in some cases.

The particle size distribution (Dv/Dp), which is the ratio of the volume average particle size (Dv) of the color resin particles to the lumbar average particle diameter (Dp) thereof, is preferably 1.0 to 1.3, more preferably 1.0 to 1.2 from the viewpoint of image reproductivity. If the color resin particles have a particle size distribution (Dv/Dp) beyond this range, the resulting toner may have reduced fluidity, facilitating degradation of image quality due to fogging or the like in some cases. The volume average particle size Dv and muter average particle diameter Dp of the color resin particles can be measured using a particle size analyzer (available from Beckman Coulter, Inc., trade name: Multisizer) or the like.

The color resin particles described above may be used as a toner as they are or as a mixture of the color resin particles and carrier particles (such as ferrite and iron pewter). To adjust the charging properties, fluidity, storage properties, and the like of the toner, using a high speed stirrer (such as trade name: FM mixer (available from NIPPON COKE & ENGINEERING CO., LTD.)), an external additive may be added to and mixed with the color resin particles to prepare a one-component toner. Furthermore, the color resin particles and an external additive may be mixed further with carrier particles to prepare a one-component toner.

Examples of the external additive include inorganic fine particles of silica, titanium oxide, aluminum oxide, zinc oxide, tin oxide, calcium carbonate, calcium phosphate, cerium oxide, and the like; organic fine particles of polymethyl methacrylate resins, silicone resins, melamine resins, and the like. Among these, inorganic fine particles are preferred, silica and titanium oxide are more preferred, and silica is particularly preferred. It is preferred that a combination of two or more fine particles be used as the external additive.

It is desired that the proportion of the external additive to be used be preferably 0.1 to 6 parts by mass, more preferably 0.2 to 5 parts by mass relative to 100 parts by mass of the color resin particles.

By compounding, as the binder resin, the copolymer including styrene monomer unit and (meth)acrylate monomer unit and compounding the resin containing a nitrogen atom as the thickener, the toner according to the first embodiment has high gloss properties and high fixing properties in a high temperature range, specifically, excellent hot offset resistance. At the same time, the toner has high print durability, that is, barely causes degradation of image quality due to fogging or the like even after printing is continuously performed on a large number of sheets.

<Second Embodiment>

The toner for electrostatic-image development according to the second embodiment of the present invention (hereinafter, simply referred to as "toner" in some cases) is a toner for electrostatic-image development apprising color resin particle containing a binder resin, a colorant, and a charge control agent, wherein the binder resin is a copolymer including styrene monomer unit and (meth)acrylate monomer unit, the copolymer is cross-linked with a cross-linking agent, the cross-linking agent contains a cross-linkable resin, the cross-linkable resin is a resin containing a nitrogen atom, and such a resin having a nitrogen atom is contained such that the content of nitrogen atom is 150 to 1500 mass ppm in the toner for electrostatic-development.

The method of producing color resin particles forming the toner according to the second embodiment will now be described.

As in the first embodiment described above, examples of the method of producing color resin particles forming the toner according to the second embodiment include dry processes and wet processes. Preferred are wet processes, and more preferred are polymerization processes such as emulsion polymerization aggregation, dispersion polymerization, and suspension polymerization processes. Among these, still more preferred is a suspension polymerization process.

The color resin particles forming the toner according to the second embodiment can be produced by any of the wet processes and the dry processes. If (A) a suspension polymerization process as a preferred wet process or (B) a pulverization process as a representative dry process used to produce the color resin particles, the production is performed by the following process. First, (A) the suspension polymerization process will be described.

(A) Suspension Polymerization Process (1) Step of Preparing a Polymerizable Monomer Composition (A) In the suspension polymerization process, first, the polymerizable monomer, the colorant, the charge control agent, the cross-linking agent, and other additives optionally used such as a release agent and a molecular weight adjuster are mixed and dissolved to prepare a polymerizable monomer composition. Curing the preparation of the polymer monomer composition, these materials are mixed using a media-type dispersing machine, for example.

In the second embodiment, the polymerizable monomer indicate polymerizable compounds. The polymerizable monomer are converted into a binder resin as a result of polymerization. To prepare resulting binder resin as a copolymer including styrene monomer unit and (meth)acrylate monomer unit, mainly a styrene monomer and an (meth) acrylate monomer are used as the polymerizable monomer.

The styrene monomer and the (meth)acrylate monomer to be used can be the same as those listed in the first embodiment described above, and the proportion of the styrene monomer unit and the proportion of the (meth)acrylate monomer unit contained in the hinder resin can be the same as those in the first embodiment described above.

A different polymerizable monomer other than the styrene monomer and the (meth)acrylate monomer may also be used as the polymerizable monomer used to prepare the binder resin used in the second embodiment. As such a different polymerizable monomer, a polymerizable monomer which is cross-linkable is preferably used. The same polymerizable monomer which is cross-linkable as those in the first embodiment described above can be used in the same amount as that in the first embodiment described above. The polymerizable monomer used in the second embodiment to prepare the binder resin preferably has a weight average molecular weight (Mw) of 500 or less.

Monovinyl monomers other than the styrene monomer and the (meth)acrylate monomer may also be used as the different, polymerizable monomer used in the second embodiment to prepare the binder resin. The same monovinyl monomers as those in the first embodiment described above can be used in the same amount as that in the first embodiment described above.

Furthermore, any macromonomer is preferably used as part of the polymerizable monomer because use of such a macromonomer results in a good balance between the storage properties of the toner and the low-temperature fixing properties thereof. The same macromonomers as those in the first embodiment can be used.

In the toner according to the second embodiment, a copolymer cross-linked with a cross-linking agent containing a cross-linkable resin is used as the binder resin. In the second embodiment, the cross-linkable resin means a resin having a cross-linking group. Accordingly, the cross-linkable resin does not include a polymerizable monomer which is cross-linkable. The cross-linkable resin has preferably two or more cross-linkable groups, more preferably 2 to 4 cross-linkable groups.

In the toner according to the second embodiment, a cross-linkable resin containing a nitrogen atom is used as the cross-linking agent, and the content of nitrogen atom derived from the cross-linkable resin is adjusted to 150 to 1500 mass ppm in the toner according to the second embodiment.

In the toner according to the second embodiment, the cross-linkable resin containing a nitrogen atom as the cross-linking agent is used during cross-linking of the copolymer such that the content of nitrogen atom falls within this range. Thereby, the resulting toner can have stable fixing properties in a which temperature range and can provide highly glossy output images. In particular, it is inferred that an appropriate amount of flexible cross-linked structures are formed between copolymer molecules or within a single molecule of the copolymer by expounding, as the crass-linkable resin, a specific amount, of a resin having two or more cross-linkable groups and a nitrogen atom. Thus, in the toner according to the second embodiment, the heat resistance can be enhanced by cross-linking paints while the elasticity of the binder resin is maintained. This results in stable fixing properties in a high temperature range and highly glossy output images.

In particular, if the black colorant is used as the colorant, the fixing properties in a high temperature range are likely to be reduced compared to the cases where other colorants are used. In the toner according to the second embodiment, a large effect is demonstrated by compounding the cross-linkable resin containing a nitrogen atom, which results in a preferred toner.

In the toner according to the second embodiment, the content of nitrogen atom derived from the cross-linkable resin is 150 to 1500 mass pan in the toner. Thereby, high gloss can be provided, and stable fixing properties in a high temperature range can be demonstrated. The content of nitrogen atom derived from the cross-linkable resin is preferably 300 to 1500 mass ppm, more preferably 350 to 1200 mass ppm, still more preferably 400 to 900 mass ppm. The content of nitrogen atom derived from the cross-linkable resin can be adjusted by controlling the content of nitrogen atom contained in the cross-linkable resin and the amount of the cross-linkable resin to be used.

The content of nitrogen atom can be measured by a chemiluminescence method using a nitrogen analyzer. While the toner according to the second embodiment may contain nitrogen atom derived from the components other than the cross-linkable resin, the content of nitrogen atom described above indicates the content of only nitrogen atom derived from the cross-linkable resin. Accordingly, the content of nitrogen atom derived from the components other than tire cross-linkable resin should be subtracted from the content of nitrogen atom measured by the chemiluminescence method.

The cross-linkable group included in the cross-linkable resin used in the second embodiment can be any cross-linkable group. Examples thereof include an (meth)acryloyl group, a vinyl group ($CH_2$═CH—), a vinylidene group ($CR_2$═C<), a vinylene group (—CH═CH—), and the like. Preferred is an (meth)acryloyl group. In this specification, the (meth)acryloyl group means an acryloyl group or a methacryloyl group.

The cross-linkable resin used in the second embodiment is preferably a resin having a urethane bond and/or a urea bend, more preferably a polyether resin having a urethane bond and/or a urea bond in the molecular structure. Examples of the polyether resin having a urethane bond and/or a urea bend include polymers or copolymers having an ether bond. Examples thereof include urethane bond and/or urea bond-containing polyoxyethylene-based polyethers, polyoxypropylene-based polyethers, polyoxybutylene-based polyethers, polyethers derived from aromatic polyhydroxy compounds such as bisphenol A and bisphenol F, and the like.

Cross-linking of the copolymer using a cross-linking agent-containing the polyether resin having a urethane bond and/or a urea bond results in a toner which has stable fixing properties in a high temperature range and can provide highly glossy output images. In particular, it is inferred that flexible cross-linked structures are formed between copolymer molecules or within a single molecule of the copolymer by compounding, as the cross-linkable resin, a polyether resin having two or more cross-linkable groups and a urethane bond and/or a urea bond. Thus, in the toner according to the second embodiment the heat resistance can be enhanced by cross-linking points while the elasticity of the binder resin is maintained. This results in stable fixing properties in a high temperature range and highly glossy output images.

A preferred cross-linkable resin used in the second embodiment is a polyether resin having two or more (meth)

acryloyl groups as the cross-linkable group and having a urethane bond and/or a urea bond.

In particular, if the black colorant is used as the colorant, the fixing properties in a high temperature range are likely to be reduced compared to the cases where other colorants are used. In the second embodiment, a large effect is demonstrated by compounding the cross-linkable resin having a urethane bond and/or a urea bond, which results in a preferred toner.

The urethane on (—NHCCO— bond) is usually a tend fog ad through reaction of an isocyanate compound (R—NCO) with a hydroxy compound. The urea bond (—NHCONH— bond) is usually a bond formed through reaction of an isocyanate compound (R—NCO) with an amino compound. In the case where the polyether resin having a urethane bond and/or a urea bond is used, the proportion of monomer unit derived from such an isocyanate compound (namely, the proportion of the urethane bond and the urea bond) in the polyether resin having a urethane bend and/or a urea bond is preferably 0.15% by mass or more, more preferably 0.25 to 2.5% by mass, still more preferably 0.50 to 2.0% by mass to more appropriately enhance the gloss properties and the fixing properties in a high temperature range. The proportion of the monomer unit derived from such an isocyanate compound in the polyether resin having a urethane bond and/or a urea and can be determined by a known standard analysis method which can quantify the nitrogen element.

The polyether resin having a urethane bond and/or a urea bond used in the second embodiment is synthesized using a polyisocyanate, a polyether polyol, or a polyamine, for example.

Examples of the polyisocyanate include aliphatic polyisocyanates, aromatic polyisocyanates, and the like. Specific examples thereof include the same as those exemplified in the first embodiment described above.

Examples of the polyether polyol include addition polymerized products of alkylene oxides and polyols; glycols such as (poly)alkylene glycols; and the like. Specific examples thereof include the same as those exemplified in the first embodiment described above.

Examples of the polyamine include aliphatic polyamines, aromatic polyamines, and the like. Specific examples thereof include the same as those exemplified in the first embodiment described above.

To readily attain the effects of this application, the cross-linkable resin used in the second embodiment has a weight average molecular weight (Mw) of preferably 800 to 10000, more preferably 1000 to 5000, still more preferably 1200 to 3000. The weight average molecular weight (Mw) can be determined by measurement by gel permeation chromatography, for example, as a value against polystyrene standards. Specifically, the weight average molecular weight (Mw) can be measured on the same condition as that described in the first embodiment.

From the viewpoint of low-temperature fixing properties, the cross-linkable resin used in the second embodiment has a glass transition temperature (Tg) of preferably 50 to 120° C., more preferably 60 to 110° C., still more preferably 70 to 100° C.

The amount of the cross-linking agent to be used is preferably 0.3 to 5.0 parts by mass, more preferably 0.5 to 4.0 parts by mass relative to 100 parts by mass of the polymerizable monomer used to prepare the binder resin. By controlling the amount of the cross-linking agent to be used within this range, the resulting toner can haw appropriately enhanced gloss properties and further enhanced fixing properties in a high temperature range.

In the second embodiment, preferably, the cross-linking agent is added in the form of a solution prepared by dissolving the cross-linking agent in a solvent. Thereby, the effects of adding the cross-linking agent can be more appropriately demonstrated. The solvent can be any solvent which can dissolve the cross-linking agent. Examples thereof include dimethyl sulfoxide, N-methyl-2-pyrrolidone, N-formylmorpholine, and the like. If the cross-linking agent is added in the form of a solution of the resin dissolved in a solvent, the proportion of the cross-linking agent in the solution is not particularly limited. The proportion is preferably 10 to 60% by mass, more preferably 30 to 55% by mass.

A commercially available product, may be used as the cross-linking agent. Examples of commercially available products of the polyether resin having an (meth)acryloyl group and a urethane bond and/or a urea bond include trade name TA-640BU2 (available from NOF CORPORATION), and the like.

In the second embodiment, which includes a colorant and a charge control agent, the same colorant and charge control agent as those in the first embodiment described above can be used.

It is preferred that a release agent be further added as another additive. The same release agent as that in the first embodiment described above can be used in the same amount as that in the first embodiment described above.

Furthermore, a molecular weight adjuster may be used as another additive. The same molecular weight adjuster as that in the first embodiment described above can be used in the same amount as that in the first embodiment described above.

In the second embodiment, the polymerizable monomer composition can be prepared by mixing the components described above with a media-type dispersing machine or the like. In the second embodiment, the viscosity at 25° C. of the polymerizable monomer composition thus prepared is preferably controlled within the same range as that in the first embodiment for the same reason as that in the first embodiment described above.

(2) Suspending Step of Preparing Suspension (Droplet Formation Step)

In the next step, the polymerizable monomer composition prepared through (1) Step of preparing polymerizable monomer composition above can be dispersed and suspended in an aqueous dispersive medium to prepare a suspension (polymerizable monomer composition dispersion). In the second embodiment, the suspension can be prepared in the same manner as in the first embodiment except that the polymerizable monomer composition prepared through (1) Step of preparing polymerizable monomer composition above is used.

(3) Polymerization Step

The desired suspension (aqueous dispersive median containing droplet of the polymerizable monomer composition) prepared through (2) Step of preparing suspension (droplet formation step) above is heated to initiate polymerization. Thereby, an aqueous dispersion of color resin particles is prepared. In the second embodiment, the aqueous dispersion of the color resin particles can be prepared in the same manner as in the first embodiment described above except that the suspension prepared through (2) Step of preparing suspension is used.

(4) Washing, Filtration, Dehydration, and Drying Steps

After the end of polymerization, it is preferred that the aqueous dispersion of the color resin particles prepared through (3) Polymerization step above be repeatedly, as needed, subjected to a series of operations of washing, filtration, dehydration, and drying according to a normal method. These steps can be performed by the same methods as in the first embodiment described above.

(B) Pulverization Process

If the pulverization process is used, the color resin particles are produced by the following process.

First, the binder resin, the colorant, the charge control agent, and other additives optionally used, such as a release agent and a molecular weight adjuster, are mixed using the same mixer as that in the first embodiment described above. In the next step, using the resulting mixture from the above step, color resin particles can be prepared by the same method as in the first embodiment described above.

The binder resin, the colorant, the charge control agent, and optional other additives such as a release agent and molecular weight adjuster used in the pulverization process can be those listed in (A) Suspension polymerization process described above. The color resin particles prepared by the pulverization process can be core-shell type color resin particles as the color resin particles prepared by (A) Suspension polymerization process described above.

(Color Resin Particles)

The color resin particles are prepared through (A) Suspension polymerization process or (B) Pulverization process above.

The color resin particles forming a toner will now be described. The color resin particles described below comprise both color resin particles of a core-shell type and those of a non-core-shell type.

From the viewpoint of image reproductivity, the color resin particles have a volume average particle size Dv of preferably 3 to 15 μm, more preferably 4 to 9 μm, still more preferably 5 to 8 μm. If the color resin particles have a volume average particle size Dv below this range, the resulting toner may have reduced fluidity, facilitating degradation of image quality due to fogging or the like in some cases. In contrast, if the color resin particles have a volume average particle size Dv beyond this range, the resolutions of the resulting images may be reduced in some cases.

The particle size distribution (Dv/Dp), which is the ratio of the volume average particle size (Dv) of the color resin particles to the number average particle diameter (Dp) thereof preferably 1.0 to 1.3, more preferably 1.0 to 1.2 from the viewpoint of image reproductivity. If the color resin particles have a particle size distribution (Dv/Dp) beyond this range, the resulting toner may have reduced fluidity, facilitating degradation of image quality due to fogging or the like in some cases. The volume average particle size Dv and number average particle diameter Dp of the color resin particles can be measured by the same method as in the first embodiment described above.

The color resin particles described above may be used as a toner as they are or as a mixture of the color resin particles and carrier particles (such as ferrite and iron powder). To adjust charging properties, fluidity, storage properties, and the like of the toner, using a high speed stirrer (such as trade name: FM mixer (available from NIPPON COKE & ENGINEERING CO., LTD.)), and an external additive may added to and mixed with the color resin particles to prepare a one-component toner. Furthermore, the color resin particles and an external additive may be mixed further with carrier particles to prepare a two-component toner.

The same external additive as that in the first embodiment described above can be used in the same amount as that in the first embodiment described above.

By compounding, as the binder resin, the copolymer which includes styrene monomer unit and (meth)acrylate monomer unit and is cross-linked on the specific condition, the toner according to the second embodiment has high gloss properties and high fixing properties in a high temperature range, specifically, excellent hot offset resistance.

EXAMPLES

Hereinafter, the present invention will be more specifically described by way of Examples and Comparative Examples, but the present invention will not be limited only to these Examples. To be noted, "part(s)" and "%" are mass-based unless otherwise specified. The test methods performed in Examples and Comparative Examples are as described below.

(1) Measurement of Nitrogen Atom Content Derived from Thickener in Toner and Nitrogen Atom Content derived from Cross-Linkable Resin in Toner The nitrogen atom content derived from the thickener in the toner aid the nitrogen atom content derived from the cross-linkable resin in the toner were measured by a chemiluminescence method using a nitrogen analyzer. Specifically, a toner sample was thermally decomposed in the presence of a catalyst, and the nitrogen component in the toner was oxidized to obtain a nitrogen monoxide gas. The nitrogen monoxide gas was reacted with ozone to generate chemiluminescence, and the intensity of the resulting light was measured. Using a calibration curve preliminarily created, the nitrogen atom content in the toner was quantified. A difference between the nitrogen atom content in each of the toners according to Examples 1-1 to 1-7 and Comparative Examples 1-1 to 1-4 and the nitrogen atom content in the toner without, the thickener (Comparative Example 1-1) was defined as the nitrogen atom content derived from the thickener in time toner. The nitrogen atom content derived from time cross-linkable resin in the toner was calculated from a difference between the nitrogen atom content in each of the toners according to Examples 2-1 to 2-4 and Comparative Examples 2-1 to 2-3 and the nitrogen atom content in the toner without the cross-linkable resin (Comparative Example 2-1).

(2) Viscosity of Polymerizable Monomer Composition

The viscosity of the polymerizable monomer composition was treasured using a B type viscometer (available from Brookfield, model name "Digital Rheometer DV-I+"). Specifically, the polymerizable monomer composition was heated to 25° C. using a thermostat water bath, and a spindle was rotated at the number of rotations of the spindle of 60 rpm for one minute, followed by measurement of the viscosity. The following spindles were used according to the viscosity range for measurement:

less than 100 mPa·s: spindle No. 1

100 mPa·s or more and less than 200 mPa·s: spindle No. 2

200 mPa·s or more and less than 1500 mPa·s: spindle No. 3

(3) Volume Average Particle Size Dv and Particle Size Distribution Dv/Dp of Color Resin Particles About 0.1 g of a sample (color resin particles) for measurement was weighed, and was placed into a beaker. As a dispersant, 0.1 ml of an alkylbenzene sulfonic acid aqueous solution (made by Fujifilm Corporation, trade name: Drywell) was added. Further, 10 to 30 mL of ISOTON II was added to the beaker, and the materials were dispersed for 3 minutes with a 20 W ultrasonic dispersing machine. Using a particle size analyzer (available from Beckman Coulter, Inc., trade name: Multisizer), the volume average particle size (Dv) and the number average particle diameter (Dp) of the color resin particles were measured under the conditions of an aperture diameter of 100 μm, a medium of ISOTON II, and the number of particles to be measured of 100,000, and the particle size distribution (Dv/Ep) was calculated.

(4) Evaluation of Gloss

Using a commercially available non-magnetic one-component developing printer modified to change the temperature of a fixing roll unit thereof, the printer was adjusted to apply 0.30 (mg/cm$^2$) of toner on paper for a solid image, and a solid image of a 5 cm square was printed on a paper sheet (available from Xerox Corporation, trade name: Vitality) at a temperature of the fixing roll (fixing temperature) of 170° C. The gloss of the resulting solid image of a 5 cm square was measured at an angle of incidence of 60° using a gloss meter (available from Nippon Denshoku Industries Co., Ltd., trade name: VGS-SENSOR). A greater value of the gloss indicates higher glossiness.

(5) Hot Offset Temperature

A hot offset test was performed using the same modified printer as that in (4) Evaluation of gloss above. In the hot offset test, while the temperature of the fixing roll unit was changed by 5° C. from 150° C. to 230° C., a print pattern having a solid black print region (print density: 100%) and a solid white print region (print density: 0%) was printed. When print dirt was observed in the solid white print region (print density 0%) at the corresponding temperature, visual observation was performed about the presence/absence of fusing of the toner to the fixing roll, that is, a hot offset phenomenon. In the hot offset test, the lowest setting temperature at which the fusing of the toner to the fixing roll occurred was defined as a hot offset temperature.

(6) Print Curability Test Under Normal Temperature and Normal Humidity (N/N) Environment Using a commercially available non-magnetic one-component developing printer (resolution: 600 dpi, printing rate: 28 sheets/min), sheets of print paper were set, a toner was filled into a toner cartridge of the developing unit, and sheets of print paper were set. The printer was left to stand under a normal temperature and normal humidity (N/N) environment at a temperature of 23° C. and a humidity of 50% RH for 24 hours, and printing was continuously performed on 10000 sheets at a print density of 5% under the same environment. A solid image (print density: 100%) was printed after every 500 sheets, and the print density of the printed solid image was measured with a reflective image densitometer (available from Gretag Macbeth GmbH, trade name: RD918). Furthermore, thereafter, a solid white image (print density: 0%) was printed. The printer was stopped during the printing of the solid white image, and the toner adhering to a non-image portion on the photosensitive marker after developing was bended to an adhesive tape (available from Sumitomo 3M Limited, product name: Scotch mending tape 810-3-18), and the tape was bonded to a sheet of print paper. In the next step, the whiteness (B) of the sheet of print paper having the adhesive tape bended thereto was measured with a whiteness meter (available from Nippon Denshoku Industries Co., Ltd.). Only an unused adhesive tape was bonded to a sheet of print paper and the whiteness (A) was measured in the same manner as above. The difference (B−A) in whiteness was defined as a fogging value. A smaller value indicates less fogging and better image quality.

The number of continuously printed sheets which satisfied the requirement that a print density of 1.3 or mere and a fogging value of 5 or less were maintained was examined, and evaluation was performed according to the following criteria:

A: The number of continuously printed sheets which satisfied the above requirement is 10000 or more.

B: The number of continuously printed sheets which satisfied the above requirement is 7000 or more and less than 10000.

C: The number of continuously printed sheets which satisfied the above requirement is less than 7000.

Example 1-1

77 Parts of styrene and 23 parts of n-butyl acrylate as monovinyl monomers, 0.3 parts of divinylbenzene as a polymerizable monomer which is cross-linkable, 12 parts of carbon black (available from Mitsubishi Chemical corporation, trade name: #25B) as a black colorant, 5.0 parts of a positive-charging charge control resin (available from Fujikura Kasei Co., Ltd., trade name: FCA-676P, quaternary ammonium salt-containing styrene/acrylic resin) as a charge control agent, 1.0 part of t-dodecylmercaptan as a molecular weight adjuster, 0.1 parts of a polymethacrylic acid ester macromonomer (available from Toagosei Chemical Industry Co., Ltd., trade name: AA6, Tg: 94° C.) as a macromonomer, 20 parts of pentaerythritol tetrastearate as a release agent, and 0.5 parts (which corresponds to 0.25 parts of the polyether resin having a urea bond, and gave a content of nitrogen atom of 153 mass ppm in the toner) of a 50% dimethyl sulfoxide solution of a polyether resin having a urea bond (available from BYK Japan K.K., trade name: BYK-D410) as a thickener were mixed by stirring with a stirrer, and were further homogenously dispersed with a media-type dispersing machine to prepare a polymerizable monomer composition. The viscosity of the polymerizable monomer composition was measured according to the method described above. The viscosity of the polymerizable monomer composition is shown in Table 1.

The polyether resin having a urea bond used in Example 1-1 had a weight average molecular weight (Mw) of 1500 and a glass transition temperature (Tg) of 94.5° C.

On the other hand, under stirring at room temperature, an aqueous solution prepared by dissolving 7.0 parts of sodium hydroxide (alkali metal hydroxide) in 50 parts of deionized water was gradually added to an aqueous solution prepared by dissolving 9.0 parts of magnesium chloride (water-soluble polyvalent metal salt) in 250 parts of deionized water to prepare a magnesium hydroxide (poorly water-soluble metal hydroxide) colloidal dispersion.

The polymerizable monomer composition prepared above was added to the resulting magnesium hydroxide colloidal dispersion, and was further stirred; then, 4.4 parts of t-butyl peroxy-2-ethylbutanoate as a polymerization initiator was added thereto. Using a high speed emulsifying/dispersing machine (available from Tokushu Kika Kogyo Co., Ltd., trade name: T. K. homomixer MARK II), dispersion was performed by high speed shear stirring at a number of rotations of 12,000 rpm to form droplet of the polymerizable monomer composition.

In the next step, the aqueous dispersion of droplet of the polymerizable monomer composition was introduced from an upper portion of the reactor to perform a polymerization reaction by heating to 89° C. When the polymerization conversion ratio reached 95%, 1 part of methyl methacrylate as a polymerizable monomer for a shell and 0.1 parts of 2,2'-azobis (2-methyl-N-(2-hydroxyethyl)-propionamide) as a water-soluble polymerization initiator for a shell dissolved in 10 parts of deionized water were added. The temperature was further kept at 90° C. for 3 hours to continue polymerization, and the reaction was terminated by cooling with water to prepare an aqueous dispersion of color resin particles. The proportions of the monomer unit forming the binder resin contained in the color resin particles were substantially identical to those of the introduced amounts (the same applies to Examples 1-2 to 1-7 and Comparative Examples 1-1 to 1-4 described later).

In the next, step, washing with an acid was performed by adding sulfuric acid to the aqueous dispersion of color resin particles under stirring until the pH reached 6.5 or less. The aqueous dispersion of color resin particles was filtered to separate water, and 500 parts of fresh deionized water was added to again form a slurry. The slurry was repeatedly subjected to a water-washing treatment (washing, filtration, and dehydration) at roan temperature (25° C.) several times. The resulting solids were separated through filtration, and were placed into a container of a vacuum dryer to vacuum dry the solids at a pressure of 30 torr and a temperature of 50° C. for 72 hours. Dried color resin particles were thereby-prepared. Using the color resin particles, the volume average particle size Dv and the particle size distribution Dv/Dp were measured according to the method described above. The results are shown in Table 1.

In the next step, 0.5 parts of silica fine particles subjected to hydrophobization and having a number average primary particle size of 7 ran and 1.2 parts of silica fine particles subjected to hydrophobization and having a BET specific surface area of 50 $m^2/g$ were added to 100 parts of the color resin particles prepared above, and were mixed by stirring using a high speed stirrer (available from NIPPON COKE & ENGINEERING CO., LTD., trade name: FM mixer) to perform an external addition treatment. A toner for electrostatic-image development according to Example 1-1 was thereby prepared. Using the resulting toner for electrostatic-image development, measurement of the nitrogen atom content derived from the thickener, evaluation of gloss, measurement of the hot offset temperature, and the print durability test under a normal temperature and normal humidity (N/N) environment were performed according to the methods described above. The results are shown in Table 1.

Example 1-2

A toner for electrostatic-image development was prepared in the same manner as in Example 1-1 except that the amount of the thickener was changed to 1.0 part (which corresponds to 0.5 parts of the polyether resin having a urea bond, and gave a content of nitrogen atom of 306 mass ppm in the toner), and was evaluated in the same manner as in Example 1-1. The results are shown in Table 1.

Example 1-3

A toner for electrostatic-image development was prepared in the same manner as in Example 1-1 except that the amount of the thickener was changed to 1.5 parts (which corresponds to 0.75 parts of the polyether resin having a urea bond, and gave a content of nitrogen atom of 459 mass ppm), and was evaluated in the same manner as in Example 1-1. The results are shown in Table 1.

Example 1-4

A toner for electrostatic-image development was prepared in the same manner as in Example 1-1 except that the amount of the thickener used was changed to 2.0 parts (which corresponds to 1.0 part of the polyether resin having a urea bend, and gave a content of nitrogen atom of 613 mass ppm), and was evaluated in the same manner as in Example 1-1. The results are shown in Table 1.

Example 1-5

A toner for electrostatic-image development was prepared in the same manner as in Example 1-1 except that the amount of the thickener was changed to 3.0 parts (which corresponds to 1.5 parts the polyether resin having a urea bond, and gave a content of nitrogen atom of 920 mass ppm), and was evaluated in the same manner as in Example 1-1. The results are shown in Table 1.

Example 1-6

A toner for electrostatic-image development was prepared in the same manner as in Example 1-1 except that 4.0 parts (which corresponds to 2.0 parts of the polyether resin having a urea bond, and gave a content of nitrogen atom of 1227 mass ppm) of a 50% N-methyl-pyrrolidone solution of a polyether resin having a urea bond (available from BYK Japan K.K., trade name: BYK-410) as the thickener was used, and was evaluated in the same manner as in Example 1-1. The results are shown in Table 1.

The polyether resin having a urea bond used in Example 1-6 had a weight average molecular weight (mw) of 1500 and a glass transition temperature (Tg) of 94.5° C.

Example 1-7

A toner for electrostatic-image development was prepared in the same manner as in Example 1-1 except that 3.0 parts (which corresponds to 1.5 parts of the polyether resin having a urea bond, and gave a content of nitrogen atom of 526 mass ppm) of a 50% N-methyl-2-pyrrolidone solution of a polyether resin having a urea bond (available from BYK Japan K.K., trade name: BYK-411) was used as the thickener, and was evaluated in the same manner as in Example 1-1. The results are shown in Table 1.

The polyether resin having a urea bond used in Example 1-7 had a weight average molecular weight (Mw) of 1800.

Comparative Example 1-1

A toner for electrostatic-image development was prepared in the same manner as in Example 1-1 except that, the thickener was not compounded, and was evaluated in the same manner as in Example 1-1. The results are shown in Table 1.

Comparative Example 1-2

A toner for electrostatic-image development was prepared in the same manner as in Comparative Example 1-1 except that the compounding amount of the divinylbenzene was changed to 0.6 parts, and was evaluated in the same manner as in Comparative Example 1-1. The results are shown in Table 1.

Comparative Example 1-3

A toner for electrostatic-image development was prepared in the same manner as in Example 1-1 except, that the amount of the thickener was changed to 0.2 parts (which corresponds to 0.1 parts of the polyether resin having a urea bond, and gave a content of nitrogen atom of 61 mass ppm), and was evaluated in the same manner as in Example 1-1. The results are shown in Table 1.

Comparative Example 1-4

A toner for electrostatic-image development was prepared in the same manner as in Example 1-1 except that 9.0 parts (which corresponds to 4.5 parts of the polyether resin having a urea bond, and gave a content of nitrogen atom of 1533 mass ppm) of a 50% N-methyl-2-pyrrolidone solution of a polyether resin having a urea bond (available from BYK Japan K.K., trade name: BYK-411) was used as the thickener, and was evaluated in the same manner as in Example 1-1. The results are shown in Table 1.

TABLE 1

| | | | Example | | | | | | | Comparative Example | | | |
|---|---|---|---|---|---|---|---|---|---|---|---|---|---|
| | | | 1-1 | 1-2 | 1-3 | 1-4 | 1-5 | 1-6 | 1-7 | 1-1 | 1-2 | 1-3 | 1-4 |
| Amount of polymerizable monomer which is cross-linkable | | (parts) | 0.3 | 0.3 | 0.3 | 0.3 | 0.3 | 0.3 | 0.3 | 0.3 | 0.6 | 0.3 | 0.3 |
| Content of thickener | BYK-D410 | (parts) | 0.25 | 0.5 | 0.75 | 1.0 | 1.5 | — | — | — | — | 0.1 | — |
| | BYK-410 | (parts) | — | — | — | — | — | 2.0 | — | — | — | — | — |
| | BYK-411 | (parts) | — | — | — | — | — | — | 1.5 | — | — | — | 4.5 |
| Content of nitrogen atom derived from thickener in toner | | (mass ppm) | 153 | 306 | 459 | 613 | 920 | 1227 | 520 | 0 | 0 | 61 | 1533 |
| Viscosity of polymerizable monomer composition | | (mPa · s) | 88 | 230 | 310 | 370 | 540 | 980 | 90 | 48 | 48 | 62 | 1230 |
| Volume average particle size Dv | | (μm) | 6.2 | 6.2 | 6.1 | 6.0 | 5.6 | 4.5 | 4.8 | 5.3 | 5.7 | 6.2 | 4.7 |
| Particle size distribution Dv/Dp | | | 1.14 | 1.16 | 1.17 | 1.18 | 1.17 | 1.31 | 1.18 | 1.15 | 1.14 | 1.13 | 1.40 |
| Results of evaluations | Gloss | | 6.1 | 6.2 | 5.8 | 5.7 | 6.0 | 5.7 | 5.4 | 5.9 | 2.1 | 5.9 | — |
| | Hot offset temperature | (° C.) | 200 | 205 | 210 | 215 | 220 | 220 | 205 | 185 | 215 | 190 | — |
| | N/N durability | | A | A | A | A | A | B | A | A | A | A | C |

In Table 1, the anoint of the thickener shewn is the amount of only the thickener excluding the solvent.

(Evaluation of Examples 1-1 to 1-7 and Comparative Examples 1-1 to 1-4)

Fran Table 1, high gloss was provided and high hot offset temperature and stable fixing properties in a high temperature range, as well as favorable print durability, were demonstrated in the toners for electrostatic-image development comprising the color resin particles containing the binder resin comprising a copolymer including styrene monomer unit and (meth)acrylate monomer unit, the colorant, the charge control agent, and the resin containing a nitrogen atom as the thickener, and containing 150 to 1500 mass ppm of nitrogen atom derived from the thickener in the toner for electrostatic-image development (Examples 1-1 to 1-7).

In contrast, if the resin containing a nitrogen atom as the thickener was not compounded, the hot offset temperature was low and the fixing properties in a high temperature range were reduced (Comparative Example 1-1). If the amount of the polymerizable monomer which is cross-linkable used was increased to increase the hot offset temperature, the gloss properties were reduced although the hot offset temperature was increased (Comparative Example 1-2).

Furthermore, if the content of nitrogen atom contained in the thickener was less than 150 mass ppm, the hot offset temperature was low and the fixing properties in a high temperature range were reduced (Comparative Example 1-3). If the content of nitrogen atom contained in the thickener was more than 1500 mass ppm, the print durability was reduced (Corporative Example 1-4).

Example 2-1

77 Parts of styrene and 23 parts of n-butyl acrylate as monovinyl monomers, 0.7 parts of a cross-linkable resin (available from NOF CORPORATION, trade name: TA-640BU2, having three (meth)acryloyl groups), which was a polyether resin having a urethane bond and (meth) acryloyl groups, as a cross-linking agent, 12 parts of carbon black (available from Mitsubishi Chemical Corporation, trade name: #25B) as a black colorant, 5.0 parts of a positive-charging charge control resin (available from Fujikura Kasei Co., Ltd., trade name: FCA-676P, quaternary ammonium salt-containing styrene/acrylic resin) as a charge control agent, 1.0 part of t-dodecylmercaptan as a molecular weight adjuster, 0.1 parts of polymethacrylic acid ester macromonomer (available from Toagosei Chemical Industry Co., Ltd., trade name: AA6, Tg: 94° C.) as a macromonomer, and 20 parts of pentaerythritol tetrastearate as a release agent were mixed by stirring with a stirrer, and were further homogeneously dispersed with a media-type dispersing machine to prepare a polymerizable monomer composition.

The polyether resin having a urethane bond and (meth) acryloyl groups used in Example 2-1 had a weight average molecular weight (Mw) of 2300.

On the other hand, under stirring at room temperature, an aqueous solution prepared by dissolving 7.0 parts of sodium hydroxide (alkali metal hydroxide) in 50 parts of deionized water was gradually added to an aqueous solution prepared by dissolving 9.0 parts of magnesium chloride (water-soluble polyvalent metal salt) in 250 parts of deionized water to prepare a magnesium hydroxide (poorly water-soluble metal hydroxide) colloidal dispersion.

The polymerizable monomer composition prepared above was added to the resulting magnesium hydroxide colloidal dispersion, and was further stirred; then, 4.4 parts of t-butyl peroxy-2-ethylbutanoate as a polymerization initiator was added thereto. Using a high speed emulsifying/dispersing machine (available from Tokushu Kika Kogyo Co., Ltd., trade name: T. K. homomixer MARK II), dispersion was performed by high speed shear stirring at a number of rotations of 12,000 rpm to form droplet of the polymerizable monomer composition.

In the next step, the aqueous dispersion of droplet of the polymerizable monomer composition was introduced from an upper portion of the reactor to perform a polymerization reaction by heating to 89° C. When the polymerization conversion ratio readied 95%, 1 part of methyl methacrylate as a polymerizable monomer for a shell and 0.1 parts of 2,2'-azobis(2-methyl-N-(2-hydroxyethyl)propionamide) as a water-soluble polymerization initiator for a shell dissolved in 10 parts of deionized water were added. The temperature was further kept at 90° C. for 3 hours to continue polymerization, and the reaction was terminated by cooling with water to prepare an aqueous dispersion of color resin particles. The proportions of the monomer unit forming the binder resin contained in the color resin particles were substantially identical to those of the introduced amounts (the same to Examples 1-2 to 1-4 and Comparative Examples 1-1 to 1-3 described later).

In the next step, washing with an acid was performed by adding sulfuric acid to the aqueous dispersion of color resin particles under stirring until the pH reached 6.5 or less. The aqueous dispersion of color resin particles was filtered to separate water, and 500 parts of fresh deionized water was added to again form a slurry. The slurry was repeatedly subjected to a water-washing treatment (washing, filtration, and dehydration) at room temperature (25° C.) several times. The resulting solids were separated through filtration, and were placed into a container of a vacuum dryer to vacuum dry the solids at a pressure of 30 torr and a temperature of 50° C. for 72 hours. Dried color resin particles were thereby prepared. Using the color resin particles, the volume average particle size Dv and the particle size distribution Dv/Dp were measured according to the method described above. The results are shown in Table 2.

In the next step, as external additives, 0.5 parts of silica fine particles subjected to hydrophobization and having a number average primary particle size of 7 nm and 1.2 parts of silica fine particles subjected to hydrophobization and having a BET specific surface area of 50 $m^2/g$ were added to 100 parts of the color resin particles prepared above, and were mixed, by stirring using a speed stirrer (available from NIPPON COKE & ENGINEERING CO., LTD., trade name: FM mixer) to perform an external addition treatment. A toner for electrostatic-image development according to Example 2-1 was thereby prepared. Using the resulting toner for electrostatic-image development, measurement of the nitrogen atom content derived from the cross-linkable resin, evaluation of gloss, and measurement of the hot offset temperature were performed, according to the methods described above. The results are shown in Table 2.

Example 2-2

A toner for electrostatic-image development was prepared in the same manner as in Example 2-1 except that the amount of the cross-linking agent used was changed to 1.0 part, and was evaluated in the same manner as in Example 2-1. The results are shown in Table 2.

Example 2-3

A toner for electrostatic-image development was prepared in the same manner as in Example 2-1 except that the amount of the cross-linking agent used was changed to 1.3 parts, and was evaluated in the same manner as in Example 2-1. The results are shown in Table 2.

Example 2-4

A toner for electrostatic-image development was prepared in the same manner as in Example 2-1 except that the amount of the cross-linking agent used was changed to 1.6 parts, and was evaluated in the same manner as in Example 2-1. The results are shown in Table 2.

Comparative Example 2-1

A toner for electrostatic-image development was prepared in the same manner as in Example 2-1 except that the cross-linkable resin as the cross-linking agent was not used and 0.3 parts of divinylbenzene as the polymerizable monomer which is cross-linkable was used, and was evaluated in the same manner as in Example 2-1. The results are shown in Table 2.

Comparative Example 2-2

A toner for electrostatic-image development was prepared in the same manner as in Comparative Example 2-1 except that the compounding amount of divinylbenzene was changed to 0.5 parts, and was evaluated in the same manner as in Example 2-1. The results are shown in Table 2.

Comparative Example 2-3

A toner for electrostatic-image development was prepared in the same manner as in Example 2-1 except that 2 parts of a cross-linkable resin (available from NIPPON SODA CO., LTD., trade name: TEAI-1000, having two (meth)acryloyl groups), which was a hydrogenated polybutadiene resin having a urethane bond and (meth)acryloyl groups, was used as the cross-linking agent, and was evaluated in the same manner as in Example 2-1. The results are shown in Table 2.

TABLE 2

| | | | Example | | | | Comparative Example | | |
|---|---|---|---|---|---|---|---|---|---|
| | | | 2-1 | 2-2 | 2-3 | 2-4 | 2-1 | 2-2 | 2-3 |
| Amount of cross-linking agent | TA-640BU2 | (parts) | 0.7 | 1.0 | 1.3 | 1.6 | — | — | — |
| | Divinylbenzene | (parts) | — | — | — | — | 0.3 | 0.6 | — |
| | TEAI-1000 | (parts) | — | — | — | — | — | — | 1.9 |
| Content of nitrogen atom derived from cross-linkable resin in toner | | (mass ppm) | 306 | 438 | 569 | 700 | 0 | 0 | 287 |
| Volume average partice size Dv | | (μm) | 6.8 | 6.7 | 6.8 | 6.1 | 5.3 | 5.4 | 5.4 |
| Particle size distribution Dv/Dp | | | 1.12 | 1.11 | 1.11 | 1.13 | 1.15 | 1.16 | 1.17 |
| Results of evaluations | Gloss | | 6.2 | 5.9 | 5.0 | 4.2 | 5.9 | 2.1 | 4.5 |
| | Hot offset temperature | (° C.) | 205 | 215 | 215 | 220 | 185 | 215 | 185 |

Evaluation of Examples 2-1 to 2-4 and Comparative Examples 2-1 to 2-3

From Table 2, high gloss was provided and high hot offset temperature and stable firing properties in a high temperature range were demonstrated in the toners for electrostatic-image development comprising the color resin particles containing the binder resin comprising a copolymer including styrene monomer unit and (meth)acrylate monomer unit and cross-linked with the cross-linking agent in the specific condition, the colorant, and the charge control agent (Examples 2-1 to 2-4).

In contrast, if the binder resin comprising a copolymer cross-linked with the cross-linking agent in the specific condition was not compounded, compatibility between high gloss properties and high hot offset temperature was not obtained (Comparative Examples 2-1 and 2-2).

In Comparative Example 2-3, although the gloss properties were excellent, the hot offset temperature was reduced.

The invention claimed is:

1. A toner for electrostatic-image development comprising color resin particle containing a binder resin, a colorant, a charge control agent, and a thickener, wherein the binder resin is a copolymer including styrene monomer unit and (meth)acrylate monomer unit, the content of the thickener is 0.2 to 5.0 parts by mass relative to 100 parts by mass of the binder resin, the thickener is a resin containing a nitrogen atom, and the content of nitrogen atom is 150 to 1500 mass ppm in the toner for electrostatic-image development.

2. The toner for electrostatic-image development according to claim 1, wherein the thickener is a resin having a urethane bond and/or a urea bond.

3. The toner for electrostatic-image development according to claim 1, wherein the thickener is a polyether resin having a urethane bond and/or a urea bond.

4. A toner for electrostatic-image development comprising color resin particle containing a binder resin, a colorant, and a charge control agent, wherein the binder resin is a copolymer including styrene monomer unit and (meth)acrylate monomer unit, the copolymer is cross-linked with a cross-linking agent, the cross-linking agent contains a cross-linkable resin, the cross-linkable resin is a resin containing a nitrogen atom, the content of the cross-linking agent is 0.3 to 5.0 parts by mass relative to 100 parts by mass of the binder resin, and the content of nitrogen atom is 150 to 1500 mass ppm in the toner for electrostatic-image development.

5. The toner for electrostatic-image development according to claim 4, wherein the cross-linkable resin is a resin having a urethane bond and/or a urea bond.

6. The toner for electrostatic-image development according to claim 4, wherein the cross-linkable resin is a polyether resin having a urethane bond and/or a urea bond.

7. The toner for electrostatic-image development according to claim 4, wherein the cross-linkable resin is a resin having a urethane bond and an (meth)acryloyl group.

8. The toner for electrostatic-image development according to claim 1, wherein the binder resin contains 60 to 90% by mass of the styrene monomer unit and 10 to 40% by mass of the (meth)acrylate monomer unit.

9. A method for manufacturing the toner for electrostatic-image development according to claim 1, the method comprising:

a step of preparing color resin particle by dispersing a polymerizable monomer composition comprising a polymerizable monomer, the colorant, the charge control agent, and the thickener and having a viscosity at 25° C. of 100 to 1000 mPa·s in an aqueous dispersive medium to form a droplet, and polymerizing the droplet, wherein the polymerizable monomer includes at least a styrene monomer and an (meth)acrylate monomer, the thickener is a resin containing a nitrogen atom, and the content of nitrogen atom is 150 to 1500 mass ppm in the toner for electrostatic-image development.

10. The method for manufacturing the toner for electrostatic-image development according to claim 9, wherein the polymerizable monomer further includes a polymerizable monomer which is cross-linkable, and the amount of the polymerizable monomer which is cross-linkable to be used is 2.0 parts by mass or less in 100 parts by mass of the total amount of the polymerizable monomer.

11. A method for manufacturing the toner for electrostatic-image development according to claim 4, the method comprising:

a step of preparing color resin particle by dispersing a polymerizable monomer composition comprising a polymerizable monomer, the colorant, the charge control agent, and the cross-linking agent in an aqueous dispersive medium to form a droplet, and polymerizing the droplet, wherein the polymerizable monomer includes at least a styrene monomer and an (meth)acrylate monomer, the cross-linking agent contains a cross-linkable resin, the cross-linkable resin is a resin containing a nitrogen atom, and the content of nitrogen atom is 150 to 1500 mass ppm in the toner for electrostatic-image development.

* * * * *